United States Patent [19]

Milberger et al.

[11] Patent Number: 4,569,404

[45] Date of Patent: Feb. 11, 1986

[54] MUDLINE CASING HANGER

[75] Inventors: Lionel J. Milberger; Donald Baron; Paul C. Berner, all of Houston, Tex.

[73] Assignee: Vetco Offshore, Inc., Ventura, Calif.

[21] Appl. No.: 592,051

[22] Filed: Mar. 22, 1984

[51] Int. Cl.[4] ..... E21B 23/03

[52] U.S. Cl. ..... 175/208; 175/217; 285/141

[58] Field of Search ..... 166/208, 217; 285/141, 285/321-323

[56] References Cited

U.S. PATENT DOCUMENTS

| | | | |
|---|---|---|---|
| 3,405,763 | 10/1968 | Pitos et al. | 285/141 |
| 3,893,717 | 7/1975 | Nelson | 166/208 |
| 4,232,889 | 11/1980 | Putch | 285/321 |
| 4,373,752 | 2/1983 | Nelson | 166/208 |
| 4,468,055 | 8/1984 | Reimert | 285/141 |

*Primary Examiner*—Stephen J. Novosad
*Assistant Examiner*—William P. Neuder
*Attorney, Agent, or Firm*—Edward L. Kochey, Jr.

[57] ABSTRACT

A mudline casing hanger assembly in which the support collet 16 has the upper end and support segments biased outwardly, with the lower end (34) push down portion biased inwardly. The lower end can be expanded (58) at the support elevation with load applied on a nonlocking shoulder (36).

6 Claims, 4 Drawing Figures

MUDLINE CASING HANGER

BACKGROUND OF THE INVENTION

This invention relates to oil and gas well casing hanger apparatus, and in particular to a mudline casing hanger assembly for supporting the casing at the mudline of a subsea well.

In such an apparatus commonly known as the mudline suspension system, a plurality of strings of casing are concentrically located, each one being supported within the successively outer one at the mudline. Each casing string which runs from the hanger downwardly is matched by an upward extension or conductor passing to the surface platform. Such a system is characterized by the severe limitation of annular space through which to run a hanger for support from the next adjacent hanger body.

This problem of landing a casing hanger inside another casing hanger has led to a number of solutions with respect to collapsing and expanding load transferring devices. They have generally been resilient devices such as "C" rings which in the relaxed condition are expanded. These are then held in, and pulled down by various retaining rings and shear pins, so that they may enter the casing and be pulled down through the blowout preventer and casing to the hanger position.

Many of these devices require considerable machining, and some are not susceptible to being recocked should they inadvertently come loose during running, or for lifting the string for reciprocation. Some have limitations on retrieval should there be a need to lift the casing string after setting the hanger.

DESCRIPTION OF THE PREFERRED EMBODIMENT

Figure 1:
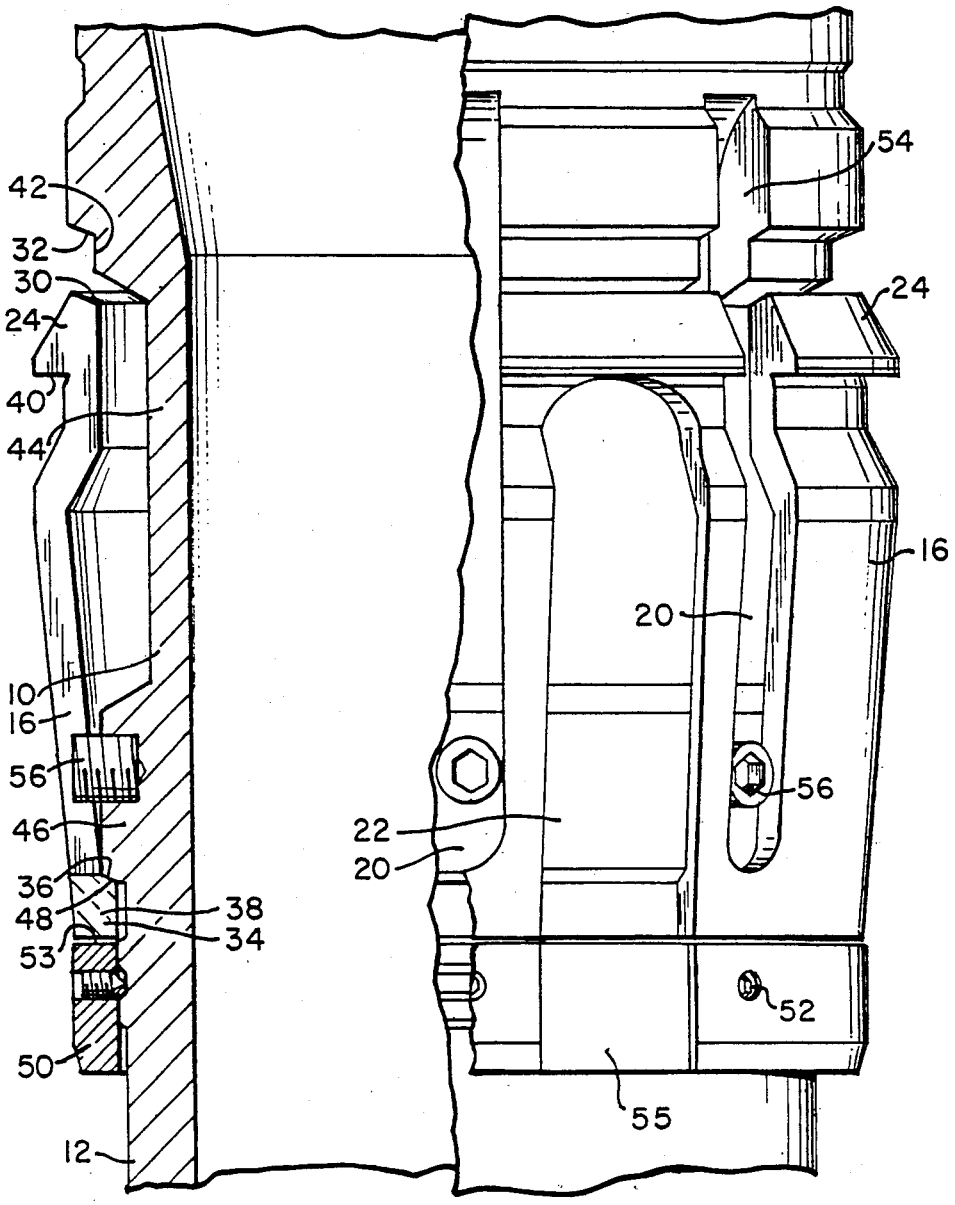
FIG. 1 illustrates the collet on a inner casing hanger body before running the hanger.
Figure 4:
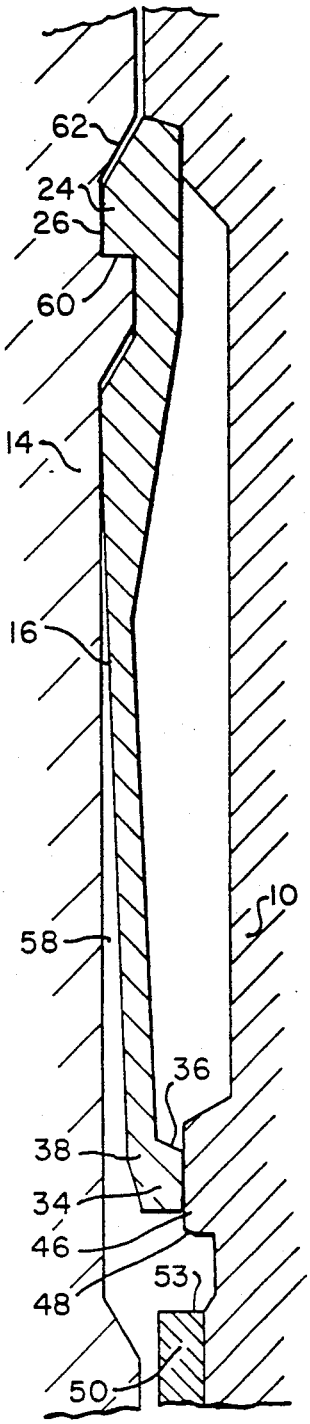
FIG. 4 illustrates the collet in the latched position.

Casing hanger body 10 serves the function of supporting a string of casing 12 from a tubular member 14, such as a previously run casing hanger. A collet 16 engages both the casing hanger body and the outer tubular member to support the load.

The collet 16 is diametrically expandable and compressible, and will in fact during its use be compressed at the top and expanded at the bottom. To permit this, the collet has a plurality of vertical slots 20 opening upwardly, and a plurality of vertical slots 22 opening downwardly with these slots alternating and overlapping one another. The collet includes outwardly extending support segments 24 at an upper elevation for mating with a first recess 26 on the outer tubular member. An upwardly facing load shoulder 30 is located on the top of each segment for mating with downwardly facing load shoulder 32 of the casing hanger body.

The collet has at its lower end an inwardly extending ring 34 with an inwardly extending upwardly facing shoulder 36.

The collet 16 in its relaxed condition has an inverted truncated frustoconical shape. That is, the lower end 38 has a lesser diameter than the upper end 40. The shape is substantially shown in FIG. 1, although the actual shape could be such that the lower end 38 has even a lesser diameter than illustrated.

The casing hanger body 10 has preferably a vertical backup section 42 just below the load shoulder 32. This performs the function of backing up the collet when it is latched and carrying load. Below this first reduced diameter portion there is a second lesser diameter portion 44, which permits the collet to be compressed to a smaller diameter than its natural relaxed position.

An outwardly extending ring 46 is located within the second reduced diameter portion and includes thereon a downwardly facing push shoulder 48. Both the push shoulder 48 and the mating shoulder 36 preferably have an angle with respect to the horizontal of between 20° and 45°. In any event, they should not form a locking angle since it is required that a downward force from shoulder 48 against shoulder 36 act to urge the bottom portion 38 of collet 16 outwardly.

The retaining ring 50 has an upwardly facing recovery surface 53 at the top thereof.

The casing hanger body has this retaining ring removably threaded thereto and restrained from rotation by set screws 52. Flow slots 55 in the retaining ring are held in alignment with vertical slots 22 to provide a generous flowby path.

The casing hanger body 10 has flow slots 54 through the area of load shoulder 32. The upper slots 20 of the collet 16 are maintained in alignment with slots 54 by set screws 56 which align and prevent rotation of the collet. These set screws are secured into the casing hanger body 10, and are located in the slots 20 thereby permitting vertical movement while maintaining alignment.

The outer tubular member 14 has in addition to the first recess 26, and adjacent second recess 58 at lower elevation which permits the central and lower portion of the collet to move outwardly when, and only when, it is at this support elevation.

In running a casing string the casing hanger body is secured to the top of the lower casing string to be run. The upper conductor is added, and the casing string with the casing hanger is lowered through the preceding conductor and casing string.

Figure 2:
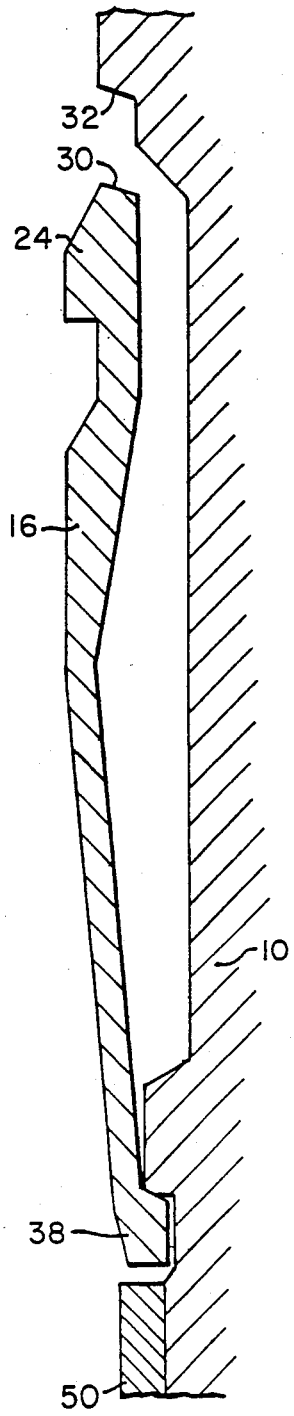
FIG. 2 is a expanded detail through a section of the collet and hanger, also before running.

Prior to running the hanger the collet 16 is slipped upwardly over the end of the casing hanger body 10. Retaining ring 50 is secured to the hanger body, thereby retaining the collet. The collet of the invention is so formed that in its relaxed position the lower end has a diameter not greater than the diameter of the hanger body at the lower elevation, and the upper end has a diameter greater than the diameter of the hanger body at the upper elevation. Accordingly, the collet takes the shape illustrated in FIGS. 1 and 2 wherein the lower end 38 tends to be retained in against shoulder 48 while the upper end 40 tends to spring outwardly.

Figure 3:
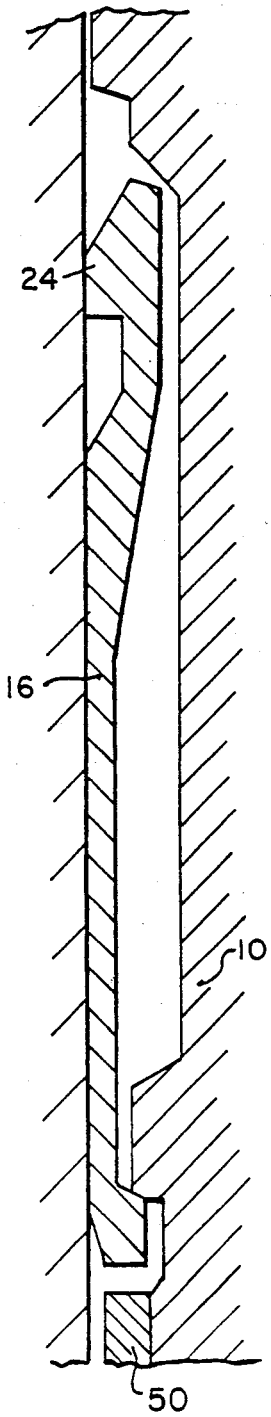
FIG. 3 is a section showing the position of the collet while running through the previous casing string.

As the casing hanger enters the conductor the collet 16 is forced inwardly at the top to the position shown in FIG. 3. The upper end of the collet has been forced back into the second recess of the hanger body. Even an upward force at this time on the collet cannot cause the lower portion 38 to come loose, since outward movement of the lower end of the collet is prevented by the conductor itself.

When the casing hanger reaches its support elevation, the support segments 24 find a mating recess 26 in the outer tubular member. Since in the relaxed position these segments move out from their compressed position the collet springs out, and the segments are secured on the load shoulder 60 of the outer tubular member. Until this time, the downward force on a collet has been only nominal to overcome friction, and the collet has accordingly been pushed down by push shoulder 48 operating against shoulder 36. Even though these surfaces do not form a locking angle, the collet could not move outwardly because of the restraint of the conductor. At the support elevation, however, there is a second adjacent recess (58) below the supporting elevation which permits the lower end of the collet to move outwardly.

Accordingly, after the segments latch, the entire casing load is placed on shoulder 48. Because of its angle it forces the lower end of the collet outwardly, this being able to occur because of the adjacent recess. The casing hanger continues to move down until the support shoulder 32 rests on the support shoulder 30 of the collet, thereby placing the casing hanger in its set position.

Recocking of the collet, and retrieval if desired, is accomplished by raising the casing string. As the hanger body is raised, the collet initially remains in position until the inwardly extending shoulder 34 of the collet clears the outwardly extending shoulder 46 of the casing hanger body. At this time, the lower end of the collet springs in toward its relaxed position, and is thereafter picked up by recovery shoulder 53 of retaining ring 50. Further movement places an upward force on the collet pressing the collet against sloped shoulder 62, thereby forcing it back in, whereby it is returned to the position illustrated in FIG. 3.

The diameter of recovery shoulder 53 on ring 50 is greater than the inside diameter formed by ring 34 in its expanded and set condition. Should the collet, for any reason, be frozen in its expanded condition, the recovery shoulder will engage the lower edge of the collet, and break it loose.

The collet accordingly is readily recockable either for retrieval, or for reciprocation of the casing string during cementing. Further, should the collet inadvertently come loose in the BOP, or in any other location, it can be recocked by raising the casing string.

We claim:

1. A mudline casing hanger assembly for supporting a casing string within and from an outer tubular member, comprising:

an outer tubular member, the inner surface thereof having a first recess, and an upwardly facing load carrying shoulder at an upper elevation, and an adjacent second recess at a lower elevation;

an inner cylindrical casing hanger body, a downwardly facing shoulder around a substantial portion of the periphery, a first reduced diameter portion below said load shoulder, a second lesser diameter reduced diameter portion below said first diameter portion, an outwardly extending ring portion extending from said second reduced diameter portion and having a downwardly facing push shoulder tapered upwardly and outwardly, an outwardly extending ring, securable around said hanger at a spaced location below said push shoulder, and having an upwardly facing recovery surface; and a diametrically expandable and compressible collet surrounding said casing hanger body, said collet in its relaxed condition having an inverted truncated frustoconical shape with the inside diameter at the lower end being less than said first lesser reduced diameter portion of said inner cylindrical hanger body and the outside diameter near the upper end being greater than the inside diameter of said outer tubular member, outwardly extending support segments at said upper elevation on said collet, for mating with said first recess and for supporting said collet from said tubular member, an upwardly facing load shoulder above said support segments, adapted to engage said downwardly facing load shoulder, an inwardly extending upwardly facing shoulder on said collet engageable with said push shoulder and tapered inwardly and downwardly;

whereby said collet when installed on said casing hanger body has the lower end biased inwardly, without reliance on any external source, and when located within said outer tubular member has the upper end biased outwardly, without reliance on any external source.

2. A casing hanger assembly as in claim 1: wherein said push shoulder and upwardly facing shoulder on said collet each are tapered at an angle with respect to the horizontal greater than the locking angle.

3. A casing hanger assembly as in claim 2: wherein said angle is between 20° and 45°.

4. A mudline casing hanger assembly for supporting a casing string within and from an outer tubular member, comprising:

an outer tubular member, the inner surface thereof having a first recess, and an upwardly facing load carrying shoulder at an upper elevation, and an adjacent second recess at a lower elevation;

an inner cylindrical casing hanger body, a downwardly facing shoulder around a substantial portion of the periphery, a first reduced diameter portion below said load shoulder, a second lesser diameter reduced diameter portion below said first diameter portion, an outwardly extending ring portion extending from said second reduced diameter portion and having a downwardly facing push shoulder tapered upwardly and outwardly, an outwardly extending ring, securable around said hanger at a spaced location below said push shoulder, and having an upwardly facing recovery surface; and a diametrically expandable and compressible collet surrounding said casing hanger body, said collet in its relaxed condition having an inverted truncated frustoconical shape, outwardly extending support segments at said upper elevation on said collet, for mating with said first recess and for supporting said collet from said tubular member, an upwardly facing load shoulder above said support segments, adapted to engage said downwardly facing load shoulder, an inwardly extending upwardly facing shoulder on said collet engageable with said push shoulder and tapered inwardly and downwardly;

said collet when installed on said casing hanger body having the lower end biased inwardly, and the upper end biased outwardly;

and having vertical slots in said collet, alignment pins secured to said casing hanger body and passing through said slots, additional slots in the upper end of said collet, slots in said casing hanger body through said load shoulder alignable with the slots in said collet, said alignment pins and slots in the collet arranged so that the upper slots in the collet are aligned with the slots in the hanger body.

5. A mudline casing hanger assembly for supporting a casing string within and from an outer tubular member, comprising:

an outer tubular member, the inner surface thereof having a first recess, and an upwardly facing load carrying shoulder at an upper elevation, and an adjacent second recess at a lower elevation;

an inner cylindrical casing hanger body, a downwardly facing shoulder around a substantial portion of the periphery, a first reduced diameter portion below said load shoulder, a second lesser diameter reduced diameter portion below said first diameter portion, an outwardly extending ring portion extending from said second reduced diameter portion and having a downwardly facing push shoulder tapered upwardly and outwardly, an outwardly extending ring, securable around said hanger at a spaced location below said push shoulder, and having an upwardly facing recovery surface; and a diametrically expandable and compressible collet surrounding said casing hanger body, said collet in its relaxed condition having an inverted truncated frustoconical shape, outwardly extending support segments at said upper elevation on said collet, for mating with said first recess and for supporting said collet from said tubular member, an upwardly facing load shoulder above said support segments, adapted to engage said downwardly facing load shoulder, an inwardly extending upwardly facing shoulder on said collet engageable with said push shoulder and tapered inwardly and downwardly;

said collet when installed on said casing hanger body having the lower end biased inwardly, and the upper end biased outwardly;

said collet being formed having alternating and longitudinally overlapping part length slots opening upwardly and downwardly.

6. A casing hanger assembly as in claim 5: having alignment pins secured to said casing hanger body, and passing through at least one of said slots opened at the bottom, slots in said casing hanger body through said load shoulder alignable with the slots in said collet which are opened at the top, said alignment pins and slots in the collet arranged so that the upper slots in the collet are aligned with the slots in the hanger body.

* * * * *